US009695018B2

(12) United States Patent
González Alemany et al.

(10) Patent No.: US 9,695,018 B2
(45) Date of Patent: Jul. 4, 2017

(54) DRIVE SYSTEM FOR HANDRAILS OF WALKWAYS AND MOVING STAIRS

(71) Applicant: THYSSENKRUPP ELEVATOR INNOVATION CENTER S.A., Gijon (ES)

(72) Inventors: Miguel Angel González Alemany, Oviedo (ES); Juan Domingo González Pantiga, Gijon (ES); José Mendiolagoitia Juliana, Gijon (ES); Eduardo Moran Garcia, Gijon (ES); Pedro Ros Zuazua, Oviedo (ES); Enrique Gonzalez Fernandez, Gijon (ES); José Ojeda Arenas, Gijon (ES); Ana Belén Quiroga Sanchez, Oviedo (ES); Luis Joaquín Fernandez Alvarez, Gijon (ES); Alberto Florez Castro, Lugo de Llanera (ES); Javier Martinez Gutierrez, Oviedo (ES)

(73) Assignee: THYSSENKRUPP ELEVATOR INNOVATION CENTER S.A., Gijon (ES)

( * ) Notice: Subject to any disclaimer, the term of this patent is extended or adjusted under 35 U.S.C. 154(b) by 0 days.

(21) Appl. No.: 15/022,891

(22) PCT Filed: Sep. 19, 2014

(86) PCT No.: PCT/EP2014/069965

§ 371 (c)(1),
(2) Date: Mar. 17, 2016

(87) PCT Pub. No.: WO2015/040145

PCT Pub. Date: Mar. 26, 2015

(65) Prior Publication Data

US 2016/0229668 A1 Aug. 11, 2016

(30) Foreign Application Priority Data

Sep. 23, 2013 (ES) ..... 201331375

(51) Int. Cl.
*B66B 23/02* (2006.01)
*B66B 23/04* (2006.01)
*B66B 21/12* (2006.01)

(52) U.S. Cl.
CPC ..... *B66B 23/04* (2013.01); *B66B 21/12* (2013.01)

(58) Field of Classification Search
CPC ..... B66B 23/04; B66B 23/06; B66B 21/12
(Continued)

(56) References Cited

U.S. PATENT DOCUMENTS 3,811,385 A 5/1974 Johnson
3,842,961 A * 10/1974 Burson ..... B66B 23/26 198/334

(Continued)

FOREIGN PATENT DOCUMENTS

CA 2762997 A1 6/2013
CN 103588078 A 2/2014

(Continued)

OTHER PUBLICATIONS

English Translation of International Search Report for PCT/EP2014/069965 dated Nov. 28, 2014 (mailing date Dec. 5, 2014).

(Continued)

*Primary Examiner* — James R Bidwell
(74) *Attorney, Agent, or Firm* — thyssenkrupp North America, Inc.

(57) ABSTRACT

Example drive systems for handrails of walkways and moving stairs may comprise a plurality of carriages. In some examples, each carriage may comprise a body with several (Continued)

leading rollers that roll along a guide that defines a handrail path. The carriage may further comprise a locking/release mechanism for selectively coupling the carriage to a drive chain of the handrail. The locking/release mechanism may comprise a hook configured to move between an engagement position wherein the carriage is coupled to the drive chain and a disengagement position wherein the carriage is uncoupled from the drive chain. In some cases, a position of the hook may be controlled by a wheel that travels along a cam profile.

20 Claims, 6 Drawing Sheets

(58) Field of Classification Search
USPC ..... 198/330, 331, 334
See application file for complete search history.

(56) References Cited

U.S. PATENT DOCUMENTS 4,240,537 A * 12/1980 Dunstan ..... B66B 23/26 198/334
7,600,628 B2 * 10/2009 Gonzalez Alemany ..... B66B 23/04 198/331
8,272,500 B2 * 9/2012 Nishikawa ..... B65G 33/04 198/465.1
2005/0217970 A1 * 10/2005 Gonzalez Alemany ..... B66B 23/04 198/334
2008/0164119 A1 * 7/2008 Gonzalez Alemany ..... B66B 21/12 198/325
2010/0000843 A1 1/2010 Nishikawa
2010/0089718 A1 * 4/2010 Gonzalez Alemany ..... B66B 23/04 198/334

FOREIGN PATENT DOCUMENTS

EP 1489035 A 12/2004
EP 1582494 A2 10/2005
EP 1939130 A1 7/2008
ES 2310465 A1 1/2009

OTHER PUBLICATIONS

English Language Abstract of ES2310465A1.
English translation of Abstract of CN 103588078 (A).
English abstract for EP1489035A.

* cited by examiner

DRIVE SYSTEM FOR HANDRAILS OF WALKWAYS AND MOVING STAIRS

CROSS REFERENCE TO RELATED APPLICATIONS

This application is a U.S. National Stage Entry of International Patent Application Serial Number PCT/EP2014/069965, filed Sep. 19, 2014, which claims priority to Spanish Patent Application No. ES P201331375 filed Sep. 23, 2013, the entire contents of both of which are incorporated herein by reference.

FIELD

The present disclosure relates to drive systems for handrails of walkways and moving stairs and, more specifically, to the drive systems of variable speed handrail grips.

BACKGROUND

It is usual to find mechanical walkways of the type mentioned above where several segments are defined that act at different speeds such that, according to the direction of operation thereof, the walkway establishes a first boarding zone at a slow speed, an acceleration zone, an intermediate zone at the maximum speed, a deceleration zone and a landing zone at a slow speed.

There are several solutions available in order to achieve the variable speed required in the acceleration and deceleration zones, including the one proposed in document ES2310465. In said solution, the power is transmitted by a network of chains of rollers from the main drive of the walkway to drive wheels that move the drive chains of each handrail. The chains are in charge of distributing along the walkway, while the variable pitch screw only changes the speed of the carriages when the same are released from the drive chain.

DETAILED DESCRIPTION

Figure 1:
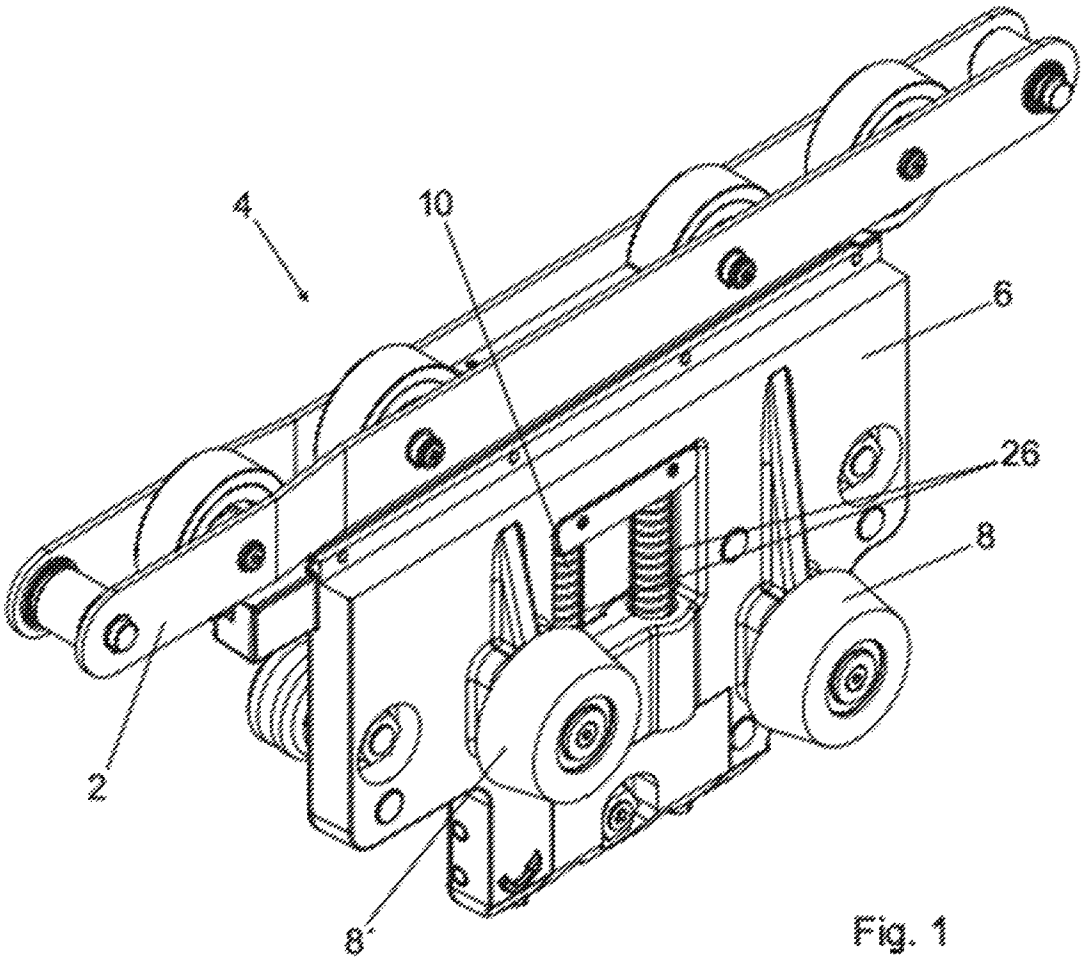
FIG. 1 is a perspective view of an inner face of an example carriage.
Figure 2:
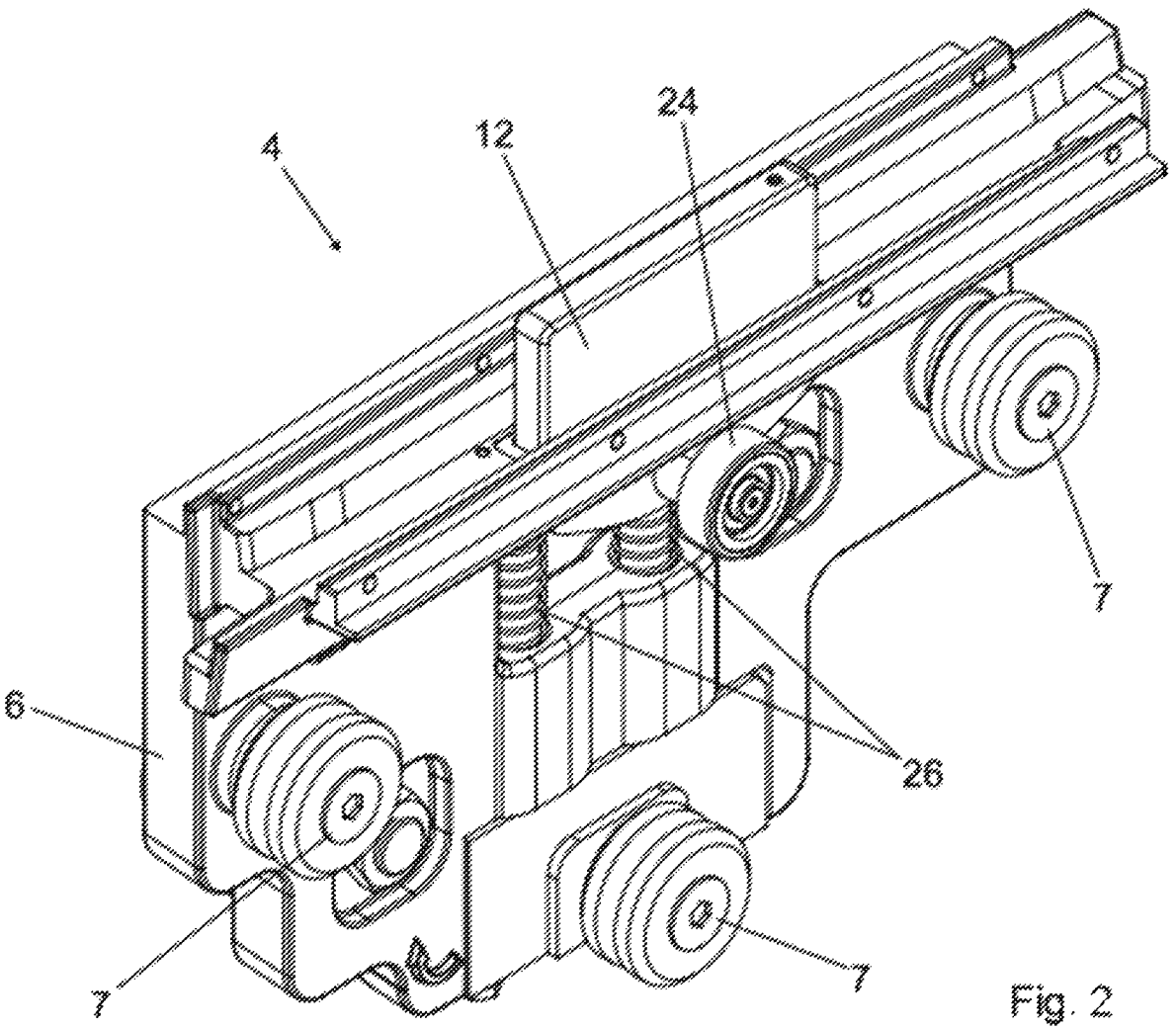
FIG. 2 is a perspective view of an outer face of an example carriage.
Figure 3:
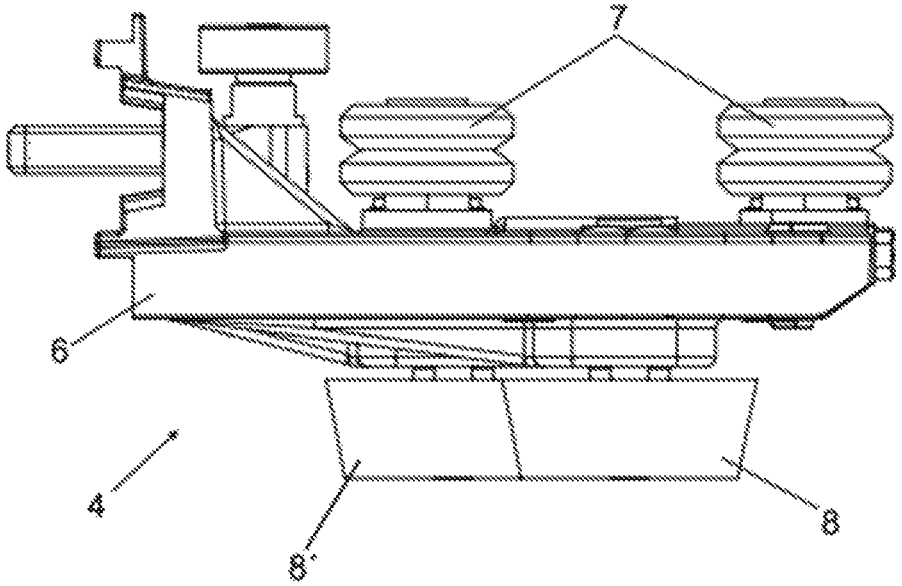
FIG. 3 is an elevated view of an example carriage.
Figure 4:
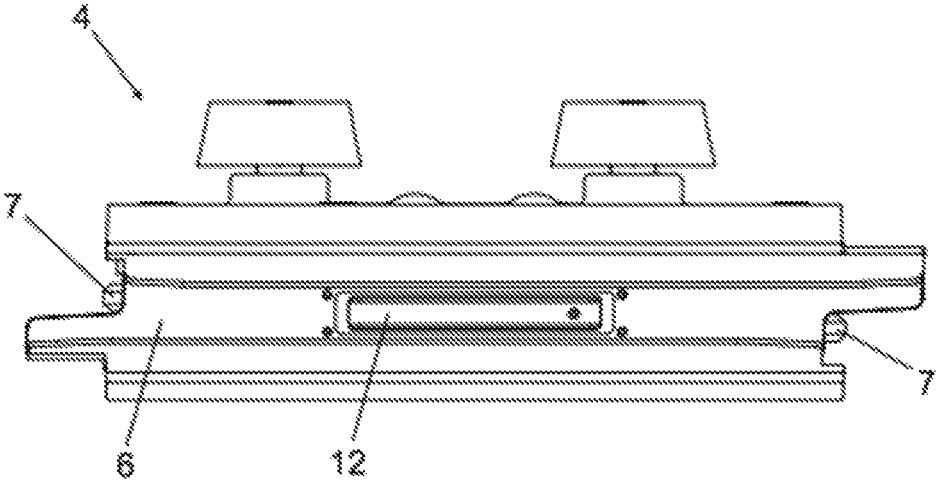
FIG. 4 is a top view of an example carriage.
Figure 5:
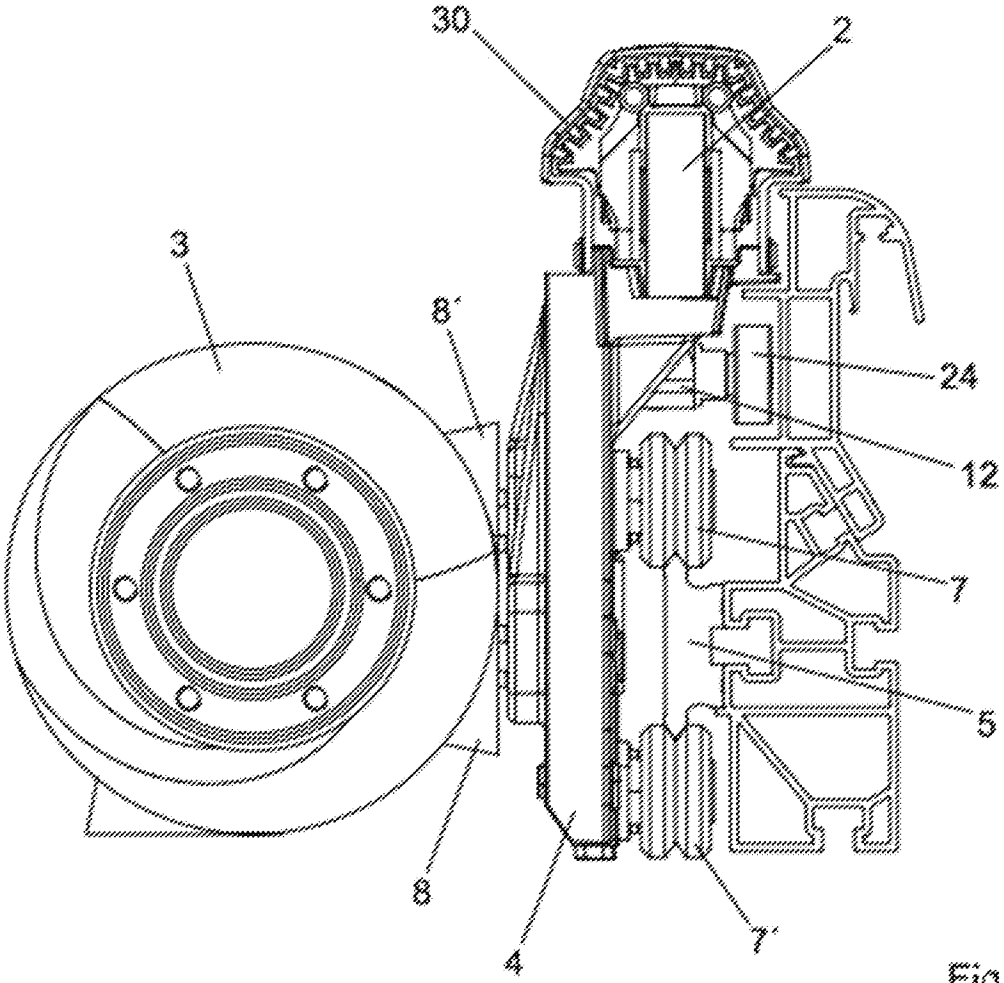
FIG. 5 is an elevated view of an example carriage set, an example drive screw, and an example drive chain.
Figure 6:
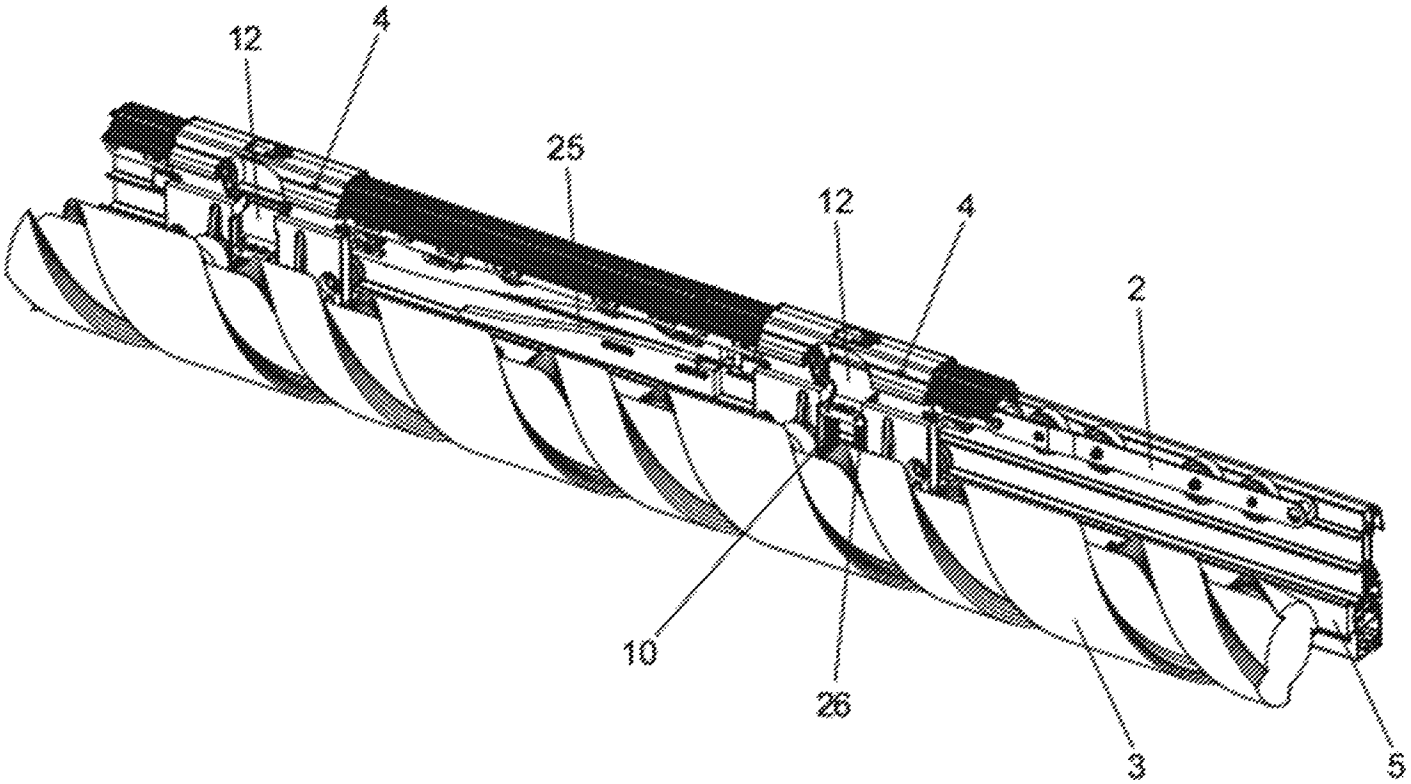
FIG. 6 is a perspective view with partial tears of an example carriage set, an example drive screw, and an example drive chain in two operative positions, locking and release.
Figure 7:
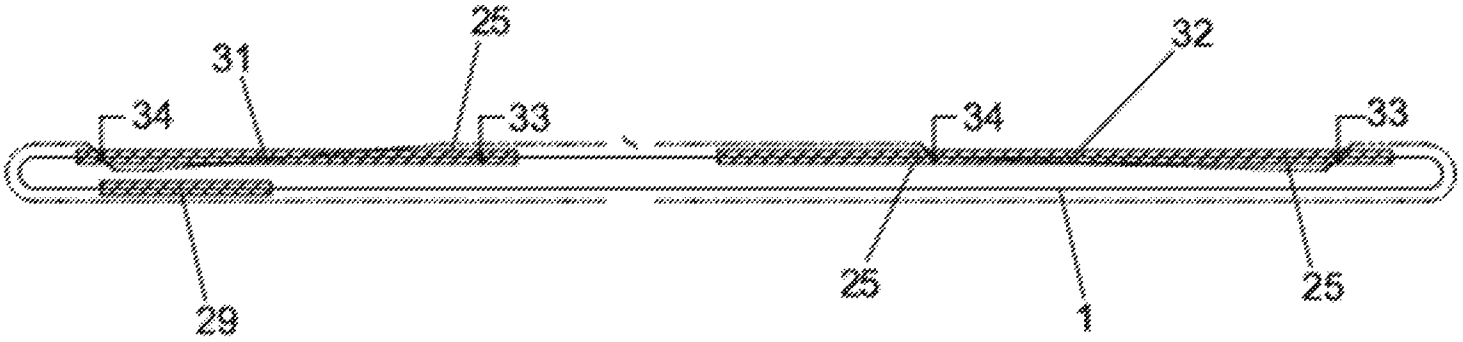
FIG. 7 is a general schematic view of an example handrail circuit wherein speed is represented by a dotted line.

Although certain example methods and apparatus have been described herein, the scope of coverage of this patent is not limited thereto. On the contrary, this patent covers all methods, apparatus, and articles of manufacture fairly falling within the scope of the appended claims either literally or under the doctrine of equivalents.

In some examples, a drive system for handrails of walkways and moving stairs may be formed at least in part by a plurality of carriages, which in turn present a body and a plurality of leading rollers configured to roll along a guide defining a handrail path. The system object of the present disclosure may also have locking-release means of the carriage with a drive chain of the handrail, which may in turn comprise a wheel and a hook connected to the wheel, and guiding means.

The wheel is configured to roll along a cam profile to move the locking means between an operative position, wherein the carriage is fixed to the chain, and an inoperative position, wherein the carriage is released from the chain.

In turn, the hook is configured to move between an engagement position, wherein the carriage is fixed to the chain and moves at the same speed thereof, transmitting the power generated in the motors that passes onto to the drive screws placed in one or more zones of the handrail path, and a disengagement position, wherein the carriage is released from said chain and moves at a variable speed in the acceleration and deceleration segments, not transmitting any power.

The guiding means are configured to guide a movement of the hook between the engagement position and the disengagement position.

Particularly, these guiding means have two columns in a guiding plane parallel to the guide.

The system can also present positioning means, which have a compression spring configured to push the hook towards the engagement position.

In addition, according to a preferred embodiment of the invention, the system presents three leading rollers arranged to prevent the pitch of the carriage. The form of arrangement of the three rollers is the following, the two first leading rollers aligned parallel to the guide, and the other leading roller not aligned with the first two leading rollers.

According to a particular embodiment, the body has an L-shaped transversal section formed by a long wing with a vertical orientation and a short wing with a horizontal orientation.

The long wing with a vertical orientation houses the guiding rollers and drive rollers. These drive rollers have a first drive roller affixed to the body engaged to the drive screw in the zones of the handrail path where said drive screw is placed, allowing the traction of the drive chain when the cam profile defines a locking situation, and the displacement of the carriage according to the movement of the drive screw independently from the drive chain when the cam profile defines a release situation. In addition, the drive rollers have a second drive roller affixed to the body engaged to the drive screw in the zones of the handrail path where said drive screw is placed, thereby avoiding the displacement of the carriage according to any movement opposite to the one defined by the drive screw.

The short wing with a vertical orientation serves as a rolling track for the drive chain in the acceleration and deceleration segments, where the speeds of said chain and carriage are substantially different.

By means of the system of the present invention, the power is generated in synchronous motors directly moving the variable pitch screws transmitting the power through the carriages when these are locked to the chain at a maximum speed, the carriages thereby being in charge of distributing the power to the drive chain which in turn moves the rest of the circuit. When the carriage is released from the drive chain, it stops transmitting power and it only changes its speed.

This new proposal eliminates a large number of mechanical connections, drastically reducing the number of components in order to achieve greater reliability, reduce vibrations and decrease the noise.

With reference now to the figures, one example of the present disclosure relates to a drive system for handrails of walkways and moving stairs formed by a plurality of carriages 4, which in turn have a body 6 and a plurality of leading rollers configured to roll along a guide 5 defining a handrail 1 path, where the guide 5 can be inside of the handrail 1.

The locking/release means in turn present a drive wheel 24, which can be a wheel that rotates freely, configured to roll along a cam profile 25 to move the locking means between an operative position, wherein the carriage 4 is locked to the chain 2, and an inoperative position, wherein the carriage 4 is released from the chain 2. Those having ordinary skill in the art will understand that the locking/release means may also be referred to as a coupling mechanism.

In addition, the carriages 4 have a hook 12 connected to the drive wheel 24, which is configured to move between an engagement position and a disengagement position. In the engagement position, the carriage 4 is locked to the chain 2, and moves at the same speed thereof, which is the maximum speed of the walkway or stair. In addition, it transmits the power generated in the motors, which passes onto the screws 3 placed in one or more zones of the handrail path, and when engaged to the carriage 4, it makes the carriage 4 transmit the force to the drive chain 2 in order for the drive chain 2 to drive the rest of the carriages 4 of the circuit.

In the disengagement position, the carriage 4 is released from said chain and moves at a variable speed in the acceleration 31 and deceleration 32 segments, not transmitting any power, and guiding means 10 configured to guide a movement of the hook 12 between the engagement position and the disengagement position.

According to another characteristics of the invention:

According to different particular embodiments of the invention, the drive system for handrails of walkways and moving stairs, the guiding means 10 comprise two columns in a guiding plane parallel to the guide 5.

In addition, the carriage presents positioning means, which in turn present a compression spring 26 configured to push the hook 12 towards the engagement position.

Preferably, the carriage 4 has three leading rollers 7 arranged to prevent the pitch of the carriage 4, thereby preventing the carriage 4 from moving from the front part to the back part, lowering and raising each part alternatively.

These leading rollers 7 are arranged such that two leading rollers 7 are aligned in a direction parallel to the guide, and a third leading roller 7 is not aligned with the two other leading rollers 7.

Particularly, the leading rollers 7 have a horizontal rotation axis.

According to a particular embodiment, the body 6 has an L-shaped transversal section formed by a long wing with a vertical orientation and a short wing with a horizontal orientation.

The long wing houses the guiding rollers 7 and drive rollers 8, 8', which present a first drive roller 8 and a second drive roller 8'.

The first drive roller 8 is affixed to the body 6 engaged to the drive screw 3 in the zones of the handrail 1 path where said drive screw 3 is placed, allowing the traction of the drive chain 2 when the cam profile 25 defines a locking situation 33, and allowing the displacement of the carriage 4 according to the movement of the drive screw 3 independently from the drive chain 2 when the cam profile 25 defines a release situation 34. The second drive roller 8' is affixed to the body 6 engaged to the drive screw 3 in the zones of the handrail 1 path where said drive screw 3 is placed, thereby avoiding the displacement of the carriage 4 according to any movement opposite to the one defined by the drive screw 3.

Specifically, this second leading roller 8' prevents the pitch and yaw movement of the carriage 4. The pitch movement prevented would make the carriage 4 move from the front part to the back part, lowering and raising each part alternatively. The yaw movement prevented would make the carriage 4 move from side-to-side with respect to the direction defined by the handrail path.

The short wing serves as a rolling track for the drive chain 2 in the acceleration 31 and deceleration 32 segments, where the speeds of said chain 2 and carriage 4 are substantially different.

According to a particular embodiment of the invention, each one of the carriages 4 can present a grip 30 joined together thereto.

What is claimed is:

1. A carriage for a drive system for handrails of walkways and moving stairs, the carriage comprising:

a body;

a plurality of leading rollers configured to roll along a guide defining a handrail path; and a coupling mechanism configured to selectively couple the carriage to a drive chain of a handrail, the coupling mechanism comprising:

a wheel configured to roll along a cam profile to move the coupling mechanism between an operative position wherein the carriage is coupled to the drive chain and an inoperative position wherein the carriage is uncoupled from the drive chain, a hook connected to the wheel and configured to move between an engagement position wherein the carriage is coupled to the drive chain, moves at the same speed as the drive chain, and transmits power to drive screws placed in one or more zones of the handrail path and a disengagement position wherein the carriage is uncoupled from the drive chain, moves at a variable speed relative to the drive chain in acceleration and deceleration segments, and does not transmit power to the drive screws, and a guiding means configured to guide movement of the hook between the engagement position and the disengagement position, wherein the plurality of leading rollers comprises three leading rollers positioned to prevent pitch of the carriage, wherein two of the three leading rollers are aligned parallel to the guide defining the handrail path and a third roller is misaligned with the two leading rollers.

2. The carriage of claim 1 wherein the guiding means comprises two columns in a guiding plane parallel to the guide defining the handrail path.

3. The carriage of claim 1 further comprising a compression spring configured to push the hook towards the engagement position.

4. The carriage of claim 1 wherein the plurality of leading rollers have a horizontal rotation axis.

5. The carriage of claim 1 further comprising a grip for attachment to a grip of an adjacent carriage.

6. A carriage for a drive system for handrails of walkways and moving stairs, the carriage comprising:

a body;

a plurality of leading rollers configured to roll along a guide defining a handrail path; and a coupling mechanism configured to selectively couple the carriage to a drive chain of a handrail, the coupling mechanism comprising:

a wheel configured to roll along a cam profile to move the coupling mechanism between an operative position wherein the carriage is coupled to the drive chain and an inoperative position wherein the carriage is uncoupled from the drive chain, a hook connected to the wheel and configured to move between an engagement position wherein the carriage is coupled to the drive chain, moves at the same speed as the drive chain, and transmits power to drive screws placed in one or more zones of the handrail path and a disengagement position wherein the carriage is uncoupled from the drive chain, moves at a variable speed relative to the drive chain in acceleration and deceleration segments, and does not transmit power to the drive screws, and a guiding means configured to guide movement of the hook between the engagement position and the disengagement position, wherein the body comprises an L-shaped transversal section comprising a long wing with a vertical orientation that houses the plurality of leading rollers and drive rollers, the drive rollers comprising:

a first drive roller affixed to the body and engageable with the drive screws in the one or more zones of the handrail path, the first drive roller permitting traction of the drive chain where the cam profile causes the wheel to move to the operative position wherein the carriage is coupled to the drive chain, and displacement of the carriage based on movement of the drive screws independent of the drive chain where the cam profile causes the wheel to move to the inoperative position wherein the carriage is uncoupled from the drive chain;

a second drive roller affixed to the body and engageable with the drive screws in the one or more zones of the handrail path, thereby avoiding displacement of the carriage based on movement opposite to that defined by the drive screws; and a short wing having a horizontal orientation that serves as a rolling track for the drive chain in the acceleration and deceleration segments wherein a speed of the drive chain is different than a speed of the carriage.

7. The carriage of claim 6 wherein the guiding means comprises two columns in a guiding plane parallel to the guide defining the handrail path.

8. The carriage of claim 6 further comprising a compression spring configured to push the hook towards the engagement position.

9. The carriage of claim 6 wherein the plurality of leading rollers have a horizontal rotation axis.

10. The carriage of claim 6 further comprising a grip for attachment to a grip of an adjacent carriage.

11. A drive system for handrails of walkways and moving stairs that comprises a plurality of carriages, wherein each of the plurality of carriages comprises:

a body;

a plurality of leading rollers configured to roll along a guide defining a handrail path;

a locking/release means for locking the carriage to and releasing the carriage from a drive chain of the handrail, the locking/release means comprising:

a wheel configured to roll along a cam profile to move the locking/release means between an operative position wherein the carriage is fixed to the drive chain and an inoperative position wherein the carriage is released from the drive chain, a hook connected to the wheel configured to move between an engagement position wherein the carriage is fixed to the drive chain and moves at a same speed as the drive chain, transmitting power generated in motors onto drive screws positioned in one or more zones of the handrail path and a disengagement position wherein the carriage is released from the drive chain and moves at a variable speed relative to the drive chain in acceleration and deceleration segments, not transmitting power onto the drive screws, and a guiding means configured to guide movement of the hook between the engagement position and the disengagement position, wherein the plurality of leading rollers of each of the plurality of carriages comprises three leading rollers positioned to prevent pitch of each carriage, wherein two of the three leading rollers are aligned parallel to the guide defining the handrail path and a third roller is misaligned with the two leading rollers.

12. The drive system of claim 11 wherein the guiding means comprises two columns in a guiding plane parallel to the guide defining the handrail path.

13. The drive system of claim 11 wherein each of the plurality of carriages further comprises a compression spring configured to push the hook towards the engagement position.

14. The drive system of claim 11 wherein the plurality of leading rollers have a horizontal rotation axis.

15. The drive system of claim 11 wherein each of the plurality of carriages comprises a grip, wherein the grips of the plurality of carriages are joined together.

16. A drive system for handrails of walkways and moving stairs that comprises a plurality of carriages, wherein each of the plurality of carriages comprises:

a body;

a plurality of leading rollers configured to roll along a guide defining a handrail path;

a locking/release means for locking the carriage to and releasing the carriage from a drive chain of the handrail, the locking/release means comprising:

a wheel configured to roll along a cam profile to move the locking/release means between an operative position wherein the carriage is fixed to the drive chain and an inoperative position wherein the carriage is released from the drive chain, a hook connected to the wheel configured to move between an engagement position wherein the carriage is fixed to the drive chain and moves at a same speed as the drive chain, transmitting power generated in motors onto drive screws positioned in one or more zones of the handrail path and a disengagement position wherein the carriage is released from the drive chain and moves at a variable speed relative to the drive chain in acceleration and deceleration segments, not transmitting power onto the drive screws, and a guiding means configured to guide movement of the hook between the engagement position and the disengagement position, wherein the body of each of the plurality of carriages comprises an L-shaped transversal section comprising a long wing with a vertical orientation that houses the plurality of leading rollers and drive rollers, the drive rollers comprising:

a first drive roller affixed to the body and engageable with the drive screws in the one or more zones of the handrail path, the first drive roller permitting traction of the drive chain where the cam profile causes the wheel to move to the operative position wherein the carriage is fixed to the drive chain, and displacement of the carriage based on movement of the drive screws independent of the drive chain where the cam profile causes the wheel to move to the inoperative position wherein the carriage is released from the drive chain;

a second drive roller affixed to the body and engageable with the drive screws in the one or more zones of the handrail path, thereby avoiding displacement of the carriage based on movement opposite to that defined by the drive screws; and a short wing having a horizontal orientation that serves as a rolling track for the drive chain in the acceleration and deceleration segments wherein a speed of the drive chain is different than a speed of the carriage.

17. The drive system of claim 16 wherein the guiding means comprises two columns in a guiding plane parallel to the guide defining the handrail path.

18. The drive system of claim 16 wherein each of the plurality of carriages further comprises a compression spring configured to push the hook towards the engagement position.

19. The drive system of claim 16 wherein the plurality of leading rollers have a horizontal rotation axis.

20. The drive system of claim 16 wherein each of the plurality of carriages comprises a grip, wherein the grips of the plurality of carriages are joined together.

* * * * *